US007191629B1

(12) United States Patent
Shore et al.

(10) Patent No.: US 7,191,629 B1
(45) Date of Patent: Mar. 20, 2007

(54) MODULAR ROLLING MILL

(75) Inventors: T. Michael Shore, Princeton, MA (US); Martyn A. Bowler, Fiskdale, MA (US)

(73) Assignee: Morgan Construction Company, Worcester, MA (US)

( * ) Notice: Subject to any disclaimer, the term of this patent is extended or adjusted under 35 U.S.C. 154(b) by 0 days.

(21) Appl. No.: 11/403,671

(22) Filed: Apr. 13, 2006

(51) Int. Cl.
*B21B 13/12* (2006.01)
*B21B 31/07* (2006.01)

(52) U.S. Cl. ..... 72/235; 72/249; 72/238

(58) Field of Classification Search ..... 72/249, 72/235, 226, 239, 238
See application file for complete search history.

(56) References Cited

U.S. PATENT DOCUMENTS

| | | | |
|---|---|---|---|
| 1,858,990 | A | 5/1932 | Foren |
| 2,664,019 | A | 12/1953 | Henderson |
| 3,505,851 | A | 4/1970 | Alvarez |
| 3,587,277 | A | 6/1971 | Pigni et al. |
| 3,665,746 | A | 5/1972 | Eibe |
| 3,776,014 | A | 12/1973 | Artz et al. |
| RE28,107 | E | 8/1974 | Wilson et al. |
| 3,831,417 | A | 8/1974 | Ritter et al. |
| 4,038,855 | A | 8/1977 | Scheib |
| 4,129,023 | A | 12/1978 | Sieurin |
| 4,182,148 | A | 1/1980 | Gilvar |
| 4,408,474 | A | 10/1983 | Hutzenlaub et al. |
| 4,537,055 | A | 8/1985 | Woodrow et al. |
| 4,706,479 | A | 11/1987 | Tominaga |
| 4,744,234 | A | 5/1988 | Poloni |
| 4,903,518 | A | 2/1990 | Kimura et al. |
| 4,907,438 | A | 3/1990 | Sasaki et al. |
| 5,144,828 | A | 9/1992 | Grotepass et al. |
| 5,152,165 | A | 10/1992 | Shore et al. |
| 5,247,820 | A | 9/1993 | Panaccione |
| 5,325,697 | A | 7/1994 | Shore et al. |
| 5,595,083 | A | 1/1997 | Shore |
| 5,921,152 | A | 7/1999 | Wang |
| 6,053,022 | A | 4/2000 | Shore |
| 6,134,930 | A | 10/2000 | Shore et al. |

(Continued)

FOREIGN PATENT DOCUMENTS

| | | |
|---|---|---|
| DE | 1602082 | 2/1970 |

(Continued)

*Primary Examiner*—Dmitry Suhol
(74) *Attorney, Agent, or Firm*—Gauthier & Connors, LLP

(57) ABSTRACT

A modular rolling mill comprises a plurality of separate rolling units arranged along a mill pass line. Each rolling unit includes at least two pairs of work rolls defining oval and round roll passes and carried on roll shafts that are staggered 90° with respect to each other. The rolling units contain intermediate drive trains configured to connect the roll shafts to parallel input shafts projecting to a first side of the pass line from the respective rolling units. A single driven line shaft is parallel to and on the first side of the pass line. Output shafts are mechanically coupled to the line shaft by bevel gear sets. The output shafts project laterally from the line shaft towards the pass line and are connected by separable couplings to the input shafts of the rolling units.

4 Claims, 3 Drawing Sheets

U.S. PATENT DOCUMENTS

| | | | |
|---|---|---|---|
| 6,161,412 | A | 12/2000 | Hogg et al. |
| 6,209,376 | B1 | 4/2001 | Zhang |
| 6,546,776 | B2 | 4/2003 | Wesolowski et al. |
| 6,763,561 | B2 | 7/2004 | Sclippa |
| 2003/0167817 | A1 | 9/2003 | Seidel et al. |

FOREIGN PATENT DOCUMENTS

| | | |
|---|---|---|
| DE | 1527659 | 3/1970 |
| DE | 1 910 431 | 9/1970 |
| DE | 28 45 052 | 4/1980 |
| GB | 805690 | 12/1958 |
| GB | 1043898 | 9/1966 |

| STAND # | ROLL PASS | DIAMETER (mm) |
|---|---|---|
| 1. | ⊘ | |
| 2. | ⊘ | 12.5 |
| 3. | ⊘ | |
| 4. | ⊘ | 10.5 |
| 5. | ⊘ | |
| 6. | ⊘ | 8.5 |
| 7. | ⊘ | |
| 8. | ⊘ | 7.0 |
| 9. | ⊘ | |
| 10. | ⊘ | 5.5 |

FIG. 4

MODULAR ROLLING MILL

BACKGROUND DISCUSSION

1. Field of the Invention

This invention relates generally to rolling mills producing long products such as rods and bars, and is concerned in particular with the provision of an improved modular rolling mill.

2. Description of the Prior Art

Block-type rolling mills are known, as disclosed for example in U.S. Pat. Nos. 4,537,055; 5,152,165; 6,134,930 and 6,546,776. These serve primarily as finishing trains in rod rolling mills, and are in widespread use throughout the world. Block type mills comprise a series of roll stands arranged in sequence to roll an alternating oval/round pass sequence, with the roll shafts of the round roll stands being staggered by 90° with respect to the roll shafts of the oval roll stands in order to roll products in a twist free manner.

Typically, the roll stands having round and oval roll passes are staggered on opposite sides of the mill pass line and are mechanically coupled to respective parallel line shafts driven at different speeds by a common mill drive connected to the line shafts by a differential gear box. Other known drive arrangements for block type mills employ a single line shaft as disclosed for example in U.S. Pat. Nos. 3,587,277 and 6,161,412, and chain drives, as disclosed in U.S. Pat. No. 4,129,023.

Although block type mills are capable of rolling products at high delivery speeds, e.g., 5.5 mm rod at 120 m/sec., their overall efficiency is compromised by a lack of flexibility when changing from one product size to another.

For example, as shown in FIG. 4, in a typical rolling program for a ten stand block type mill, when all stands are operative, a feed size having a 17 mm diameter will be rolled into a finished product having a diameter of 5.5 mm. In order to roll a finished product having a 7.0 mm diameter, roll stands 9 and 10 are rendered inoperative (a procedure commonly referred to as "dummying"). Progressively larger product sizes can be rolled by progressively dummying additional roll stands, e.g., stands 7 and 8 to roll 8.5 mm rounds, stands 5 and 6 to roll 10.5 mm rounds, etc. Because the successive roll stands are integrally joined together, in order to effect dummying, the work rolls must be removed and replaced with guides. This is a labor intensive procedure, typically taking between 20–60 minutes to complete, and occurring every 8 hours. If, conservatively speaking, one assumes an average down time of 30 minutes for each dummying operation, with a mill operating 300 days per year at a rate of 60 tons/hr, the lost production can amount to upwards of 27,000 tons/year.

In order to achieve improved efficiencies, modular mills have been developed, as disclosed for example in U.S. Pat. Nos. 5,595,083 and 6,053,022. These mills employ multiple motors driving gear boxes detachably coupled to pairs of successive rolling units. The rolling units each include roll stands with oval and round roll passes, and are interchangeable and rapidly shiftable onto and off of the mill pass line to thereby accommodate the rolling of different product sizes. Although mechanically sound and advantageously flexible, as compared to block type mills, such modular arrangements are relatively complex and expensive, both to purchase and subsequently to maintain.

The objective of the present invention is to provide an improved modular rolling mill that overcomes or at least substantially mitigates the disadvantages associated with conventional modular and block type mills.

SUMMARY OF THE INVENTION

In accordance with the present invention, a modular rolling mill comprises a plurality of separate rolling units arranged along a mill pass line. Each rolling unit includes at least two pairs of work rolls defining oval and round roll passes and carried on roll shafts that are staggered 90° with respect to each other. The rolling units contain intermediate drive trains configured to connect the roll shafts to parallel input shafts projecting to a first side of the pass line from the respective rolling units.

A single driven line shaft is parallel to and on the first side of the pass line. Output shafts are mechanically coupled to the line shaft by bevel gear sets. The output shafts project laterally from the line shaft towards the pass line and are connected by couplings to the input shafts of the rolling units. The couplings are separable to accommodate ready removal of the rolling units to an opposite second side of the pass line.

The line shaft is advantageously subdivided into segments coupled to the input shafts by the bevel gear sets, with clutches joining the shaft segments. The clutches are alternatively adjustable to either connect or disconnect the respective joined shaft segments.

Since only one line shaft is employed to drive all of the rolling units, it may be directly coupled to the mill motor without having to interpose a differential gear box.

These and other features and advantages of the present invention will now be described in further detail with reference to the accompanying drawings, wherein:

BRIEF DESCRIPTION OF THE DRAWINGS

FIG. 4 is an illustration of an exemplary rolling program.

DETAILED DESCRIPTION

Figure 1:
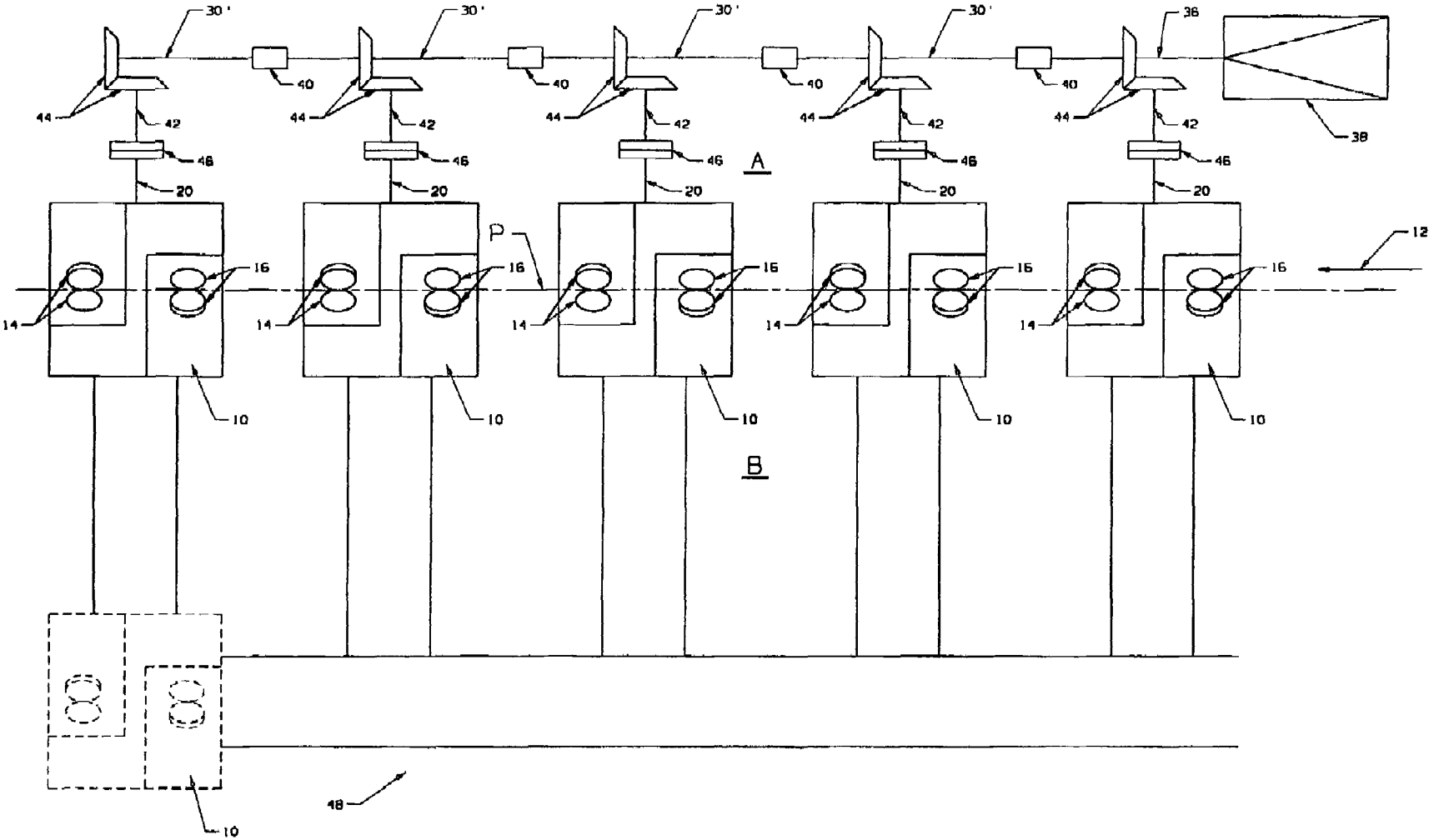
FIG. 1 is a schematic plan view of a modular rolling mill in accordance with the present invention.

With reference to FIG. 1, a modular rolling mill in accordance with the present invention comprises a plurality of separate rolling units 10 arranged along a mill pass line "P." The direction of rolling is indicated by arrow 12. Each rolling unit has at least two pairs of work rolls 14, 14 and 16, 16 configured to define oval and round roll passes. The rolls of each successive pair are staggered by 90° to effect twist-free rolling of long products, e.g., bars, rods, and the like.

Figure 2:
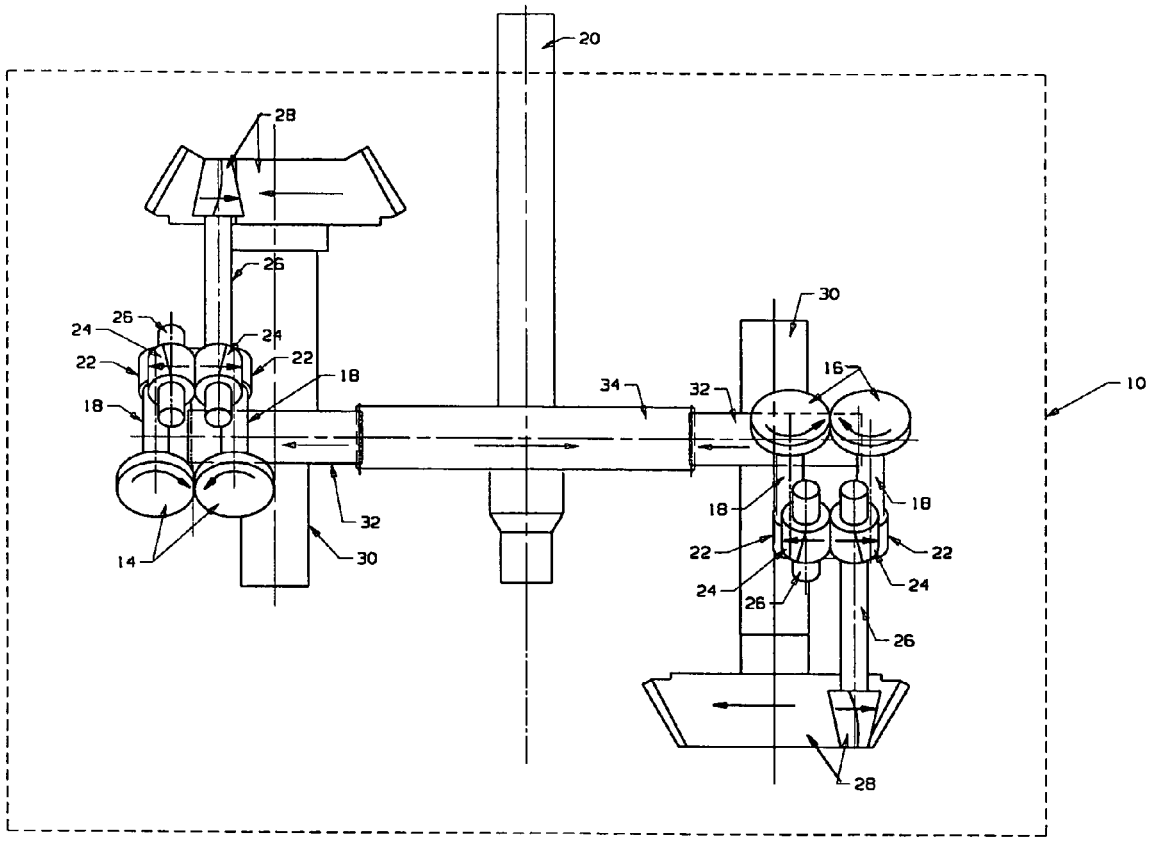
FIG. 2 is a schematic illustration of the intermediate drive train contained in the rolling units.
Figure 3:
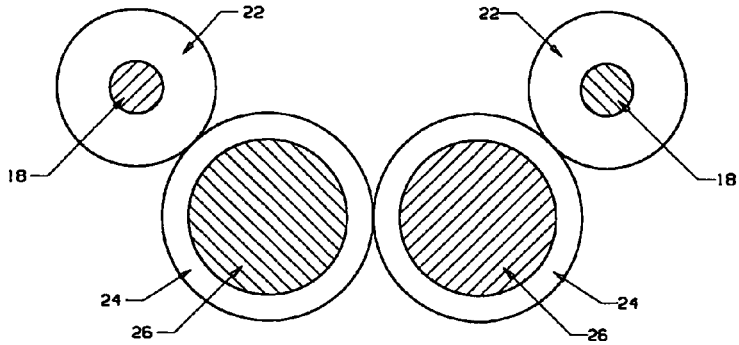
FIG. 3 illustrates the relationship of the gears in a four gear cluster incorporated in the intermediate drive train.

With reference additionally to FIGS. 2 and 3, it will be seen that the work rolls are mounted on roll shafts 18, and that intermediate drive trains are contained within the rolling units to mechanically couple the roll shafts to input shafts 20. The input shafts are parallel and project to a first side "A" of the pass line. The intermediate drive trains include gears 22 on the roll shafts meshing with intermeshed gears 24 on shafts 26, with one of the shafts 26 connected by a bevel gear set 28 to a shaft 30. The shafts 30 carry gears 32 meshing with a gear 34 on the input shaft 20.

Although not shown, it will be understood that as an alternative to this arrangement, the intermediate drive trains could be configured to drive each pair of work rolls 14, 14 and 16, 16 with separate input shafts 20.

A line shaft 36 extends along the first side A in parallel relationship to the pass line P. The line shaft is directly coupled to and driven by a drive motor 38 located at the entry end of the mill.

The line shaft 30 may be continuous, but preferably it is subdivided into segments 36' joined by clutches 40. Each line shaft segment 36' is coupled to an output shaft 42 by a bevel gear set 44. The output shafts 42 are parallel and project laterally from the line shaft towards the pass line. The clutches 40 are alternatively adjustable to mechanically connect or disconnect the respective line shaft segments.

Couplings 46 connect each output shaft 42 to a respective input shaft 20. The couplings are separable to accommodate removal of the rolling units to the second opposite side "B" of the pass line. A network of tracks 48 on side B is arranged to receive and convey rolling units removed from the pass line. A rolling unit is shown in broken lines at 10' in its removed position from the rolling line.

Preferably, the rolling units 10 are identical and thus readily interchangeable one for the other. Each rolling unit can be readily removed from the pass line and replaced by a guide. The guide may comprise part of a protective cover, as disclosed for example in U.S. Pat. No. 5,247,820.

In light of the foregoing, it will now be understood by those skilled in the art that the modular mill concept of the present invention offers significant advantages over conventional block and modular mills. For example, the ability to rapidly remove rolling units from the pass line is conservatively estimated to reduce mill down time by approximately 67%. Thus, for the exemplary rolling operation previously described, this can amount to an annual increase in production of 18,000 tons/yr. The use of a single driven line shaft, and the elimination of costly gear units between the line shaft and the mill drive motor, makes possible significant savings in capital investment as well as in subsequent maintenance costs over the life of the mill.

With regard to maintenance, it is important to note that all of the gears, shafts, and associated bearings of the intermediate drive trains are contained in the rolling units 10, and are thus accessible for periodic maintenance when the rolling units are removed from the mill pass line, without having to interrupt continued operation of the mill. Likewise, the bevel gear sets 44 of dummyed rolling units can be de-clutched from the line shaft 36 and also subjected to periodic maintenance, again while the remainder of the mill continues in operation.

We claim:

1. A modular rolling mill, comprising:

a plurality of separate rolling units arranged along a mill pass line, each rolling unit having at least two pairs of work rolls carried on roll shafts, intermediate drive trains contained within said rolling units for mechanically coupling said roll shafts to input shafts, the input shafts of said rolling units being parallel to each other and projecting to a first side of said pass line from their respective rolling units;

a line shaft parallel to and on the first side of said pass line;

means for driving said line shaft;

parallel output shafts mechanically coupled by bevel gear sets to said line shaft, said output shafts projecting laterally from said line shaft towards said pass line; and coupling means for connecting each of said output shafts to a respective one of said input shafts, said coupling means being separable to accommodate selective removal of said rolling units to a second side of said pass line opposite to said first side.

2. The modular rolling mill of claim 1 wherein said line shaft is subdivided into segments mechanically connected to said output shafts by said bevel gears sets, and further comprising clutches joining said line shaft segments, said clutches being alternatively adjustable to mechanically connect or disconnect the thus joined line shaft segments.

3. The modular rolling mill of claims 1 or 2 further comprising a network of tracks on the second side of said pass line for receiving and conveying rolling units removed from said pass line.

4. The modular rolling mill of claim 1 wherein said means for driving comprises a motor coupled directly to said line shaft.

* * * * *